US010875160B2

(12) United States Patent
Hohmann et al.

(10) Patent No.: US 10,875,160 B2
(45) Date of Patent: Dec. 29, 2020

(54) TORQUE WRENCH

(71) Applicants: Jorg Hohmann, Meschede (DE); Frank Hohmann, Warstein (DE)

(72) Inventors: Jorg Hohmann, Meschede (DE); Frank Hohmann, Warstein (DE)

( * ) Notice: Subject to any disclaimer, the term of this patent is extended or adjusted under 35 U.S.C. 154(b) by 18 days.

(21) Appl. No.: 15/578,863

(22) PCT Filed: Aug. 22, 2016

(86) PCT No.: PCT/EP2016/001416
§ 371 (c)(1),
(2) Date: Dec. 1, 2017

(87) PCT Pub. No.: WO2017/036579
PCT Pub. Date: Mar. 9, 2017

(65) Prior Publication Data

US 2018/0178356 A1 Jun. 28, 2018

(30) Foreign Application Priority Data

Sep. 2, 2015 (DE) ..... 10 2015 011 553

(51) Int. Cl.
*B25B 21/00* (2006.01)
*B25B 23/00* (2006.01)

(52) U.S. Cl.
CPC ..... *B25B 21/005* (2013.01); *B25B 23/0078* (2013.01)

(58) Field of Classification Search
CPC ..... B25B 21/005; B25B 23/0078
USPC ..... 81/57, 57.14, 57.44
See application file for complete search history.

(56) References Cited

U.S. PATENT DOCUMENTS 4,409,865 A 10/1983 Krautter et al.
4,663,997 A 5/1987 Junkers
5,203,238 A * 4/1993 Ferguson ..... B25B 21/005 81/57.39
2002/0073808 A1 6/2002 Jamra et al.
(Continued)

FOREIGN PATENT DOCUMENTS

DE 3151079 8/1982
WO 2013032963 3/2013
WO 2014176468 10/2014

OTHER PUBLICATIONS

German Application Serial No. 10 2015 011 553.7; First Office Action; dated Jun. 7, 2016; 3 pages.
(Continued)

*Primary Examiner* — David B. Thomas
*Assistant Examiner* — Thomas Raymond Rodgers
(74) *Attorney, Agent, or Firm* — John H. Thomas, P.C.

(57) ABSTRACT

A torque wrench with a ratchet and a drive for the ratchet includes a ratchet housing with two opposed side walls which have a specified distance to each other and are connected with each other. A through opening extends transversely through the two side walls, which is designed to accommodate a ratchet rotary body, wherein its axis of rotation extends parallel to the axis of the through opening. The ratchet rotary body includes a fastening means for fastening a supporting device to the torque wrench, by means of which the torque wrench can be supported perpendicularly to the axis of rotation of the ratchet rotary body.

5 Claims, 4 Drawing Sheets

(56) References Cited

U.S. PATENT DOCUMENTS

2010/0107827 A1* 5/2010 Miller ..... B25B 13/481
81/177.3
2016/0067849 A1* 3/2016 Junkers ..... B25B 13/481
81/57.3

OTHER PUBLICATIONS

PCT Application Serial No. PCT/EP2016/001416; International Search Report; dated Dec. 14, 2016; 4 pages.
Japanese Office Action; Japan Application No. JP 2018-503203; dated Jan. 22, 2019; 4 pages.

* cited by examiner

TORQUE WRENCH

CROSS-REFERENCE TO RELATED APPLICATIONS

This Is a United States patent application claiming priority from German Patent Application No. 10 2015 011 553.7 having a fling date of Sep. 2, 2015, and PCT Patent Application No. PCT/EP 2016/001416, having a filing date of Aug. 22, 2016, the contents of both of which are incorporated herein by reference.

FIELD OF THE INVENTION

This Invention relates to a torque wrench with a ratchet and a drive for the ratchet, wherein the ratchet includes a ratchet housing with two opposed side walls which have a specified distance to each other and are connected with each other, a through opening extending transversely through the two side walls, which is designed to accommodate a ratchet rotary body, wherein its axis of rotation extends parallel to the axis of the through opening, and with fastening means for fastening a supporting device to the torque wrench, by means of which the torque wrench can be supported perpendicularly to the axis of rotation of the ratchet rotary body.

BACKGROUND

A known torque wrench of this type can be assembled from a ratchet unit, which includes a ratchet with ratchet housing, and a drive unit which includes the drive for the ratchet. The drive unit includes a tab which in the assembled condition of ratchet unit and drive unit extends into the ratchet housing between its side walls. The tab and the side walls each include a bore which in the assembled condition of ratchet unit and drive unit are in alignment with each other. These bores serve for fastening various supporting devices to the torque wrench. By means of these supporting devices the torque wrench is supported, for example on the next screw or on the flange, perpendicularly to the axis of rotation of the ratchet rotary body when a torque is applied.

The supporting devices include two legs parallel to each other and arranged at a distance to each other, which legs on both sides of the torque wrench are applied to the side walls of the torque wrench. Each leg includes a bore, which bores are in alignment with each other and in the condition appropriately applied to the torque wrench also are in alignment with said bores thereof. For fastening a supporting device to the torque wrench a bolt then is guided from one side through the bore in a leg of the supporting device, then through the bores in the ratchet unit and in the drive unit, and finally through the bore in the other leg of the supporting device and is then secured in its position.

SUMMARY

It is the object underlying the invention to improve a generic torque wrench such that the fastening possibility for a supporting device is easier to handle and at the same time can take a higher load.

According to the invention, this object is solved in that the fastening means include a free space between the side walls, which is accessible from outside the torque wrench, wherein the access opening is arranged between the two side walls, and which free space is designed to accommodate a fastening portion of the supporting device, and in that the fastening means include devices for fastening the fastening portion in the free space.

By the measures according to the invention a supporting device can be fastened to a torque wrench and also be released again from the torque wrench with little space requirement and in a very simple way, wherein at the same time the manufacturing effort for the torque wrench can be reduced and the fastening means for the supporting device can be dimensioned smaller with the supporting forces or moments to be applied remaining the same. Due to the fact that the fastening means include a free space between the side walls, which is accessible from outside the torque wrench and is designed to accommodate a fastening portion of the supporting device, a fastening possibility is created for the supporting device, into which a fastening portion of the supporting device can be introduced easily and securely. As the access opening is arranged between the two side walls, the installation space or space requirement of the torque wrench transversely to its side walls is not increased by a fastening portion of the supporting device introduced into the free space, neither when mounting the same nor during the screwing operation, so that the supporting device can also be used with tight spatial conditions and can easily be inserted into the torque wrench or the torque wrench can easily be put onto the supporting device. According to the invention, fastening of the supporting device is effected exclusively at the ratchet housing, i.e. without including the drive unit. In the manufacture of the torque wrench, no tolerance influences or fitting inaccuracies resulting from elements mounted on the drive unit for fastening the supporting device therefore are present. The fastening means also include devices for fastening the fastening portion of the supporting device in the free space, i.e. fastening is effected in the free space, so that for example a fastening bolt extending transversely to the side walls must extend only between the outer surfaces of the side walls and its shearing cross sections are located close to the inner surfaces of the side walls. Due to the reduced length of the fastening bolt and the reduced distance between its shearing cross sections, the bending load of the fastening bolt is reduced and hence its capacity for bearing shear forces is increased.

Preferably, the outer circumferential edges of the two opposed side walls are connected with each other by means of a rim wall and the access opening to the free space is arranged in this rim wall. By means of these measures a guide is created for the fastening portion of the supporting device. The access opening is formed or defined by opposed portions of the side walls or by walls parallel to the side walls and by portions of the rim wall facing each other in circumferential direction of the rim wall. These boundary portions of the access opening at the same time form a guide for the fastening portion, by means of which the fastening portion is guided into the free space.

In a plane perpendicular to the axis of the through opening, the free space advantageously has a triangular cross-section which tapers into the ratchet housing. The fastening portion of the supporting device thereby can be guided into the free space even more easily. However, the free space also can have any other cross-sectional shape which is suitable for guiding and fastening the fastening portion of the supporting device. For example, other configurations of the taper of the cross-section are possible, for example a step-shaped taper. It also is conceivable that the cross-section is not tapered, but formed rectangular.

In a favorable development of the invention, the torque wrench includes a bore extending transversely through the two side walls and the free space, which bore is designed to accommodate a bolt for fastening the fastening portion of the supporting device. A safe and fast and also inexpensive fastening of the fastening portion in the free space is ensured in this way.

In an advantageous aspect of the invention the fastening portion of the supporting device includes a bore which likewise is designed to accommodate the bolt and which is in alignment with the bores in the side walls of the ratchet housing, when either the fastening portion in the free space rests against its walls or the supporting device rests against the rim wall of the ratchet housing. By means of these measures it is achieved that the bores in the side walls of the ratchet housing and in the fastening portion of the supporting device are aligned with each other without further alignment, when the fastening portion is introduced into the free space as far as possible.

A torque wrench according to the invention can be formed of a ratchet unit, which includes the ratchet with ratchet housing, and a drive unit which includes the drive for the ratchet, wherein the ratchet unit and the drive unit can releasably be assembled to form a screwdriver unit. By means of these measures it is possible to exchange the ratchet housing depending on the application and in this way adapt the opening sizes of the wrench. In this way, it is not necessary to have a separate drive unit for each ratchet housing. The torque wrench can, however, also be designed in one part, i.e. drive and ratchet then are not separable from each other, in case this is advantageous or required for certain applications.

BRIEF DESCRIPTION OF THE DRAWINGS

The Invention will be explained in detail by way of example with reference to the following drawings, in which.

DETAILED DESCRIPTION

Figure 1:
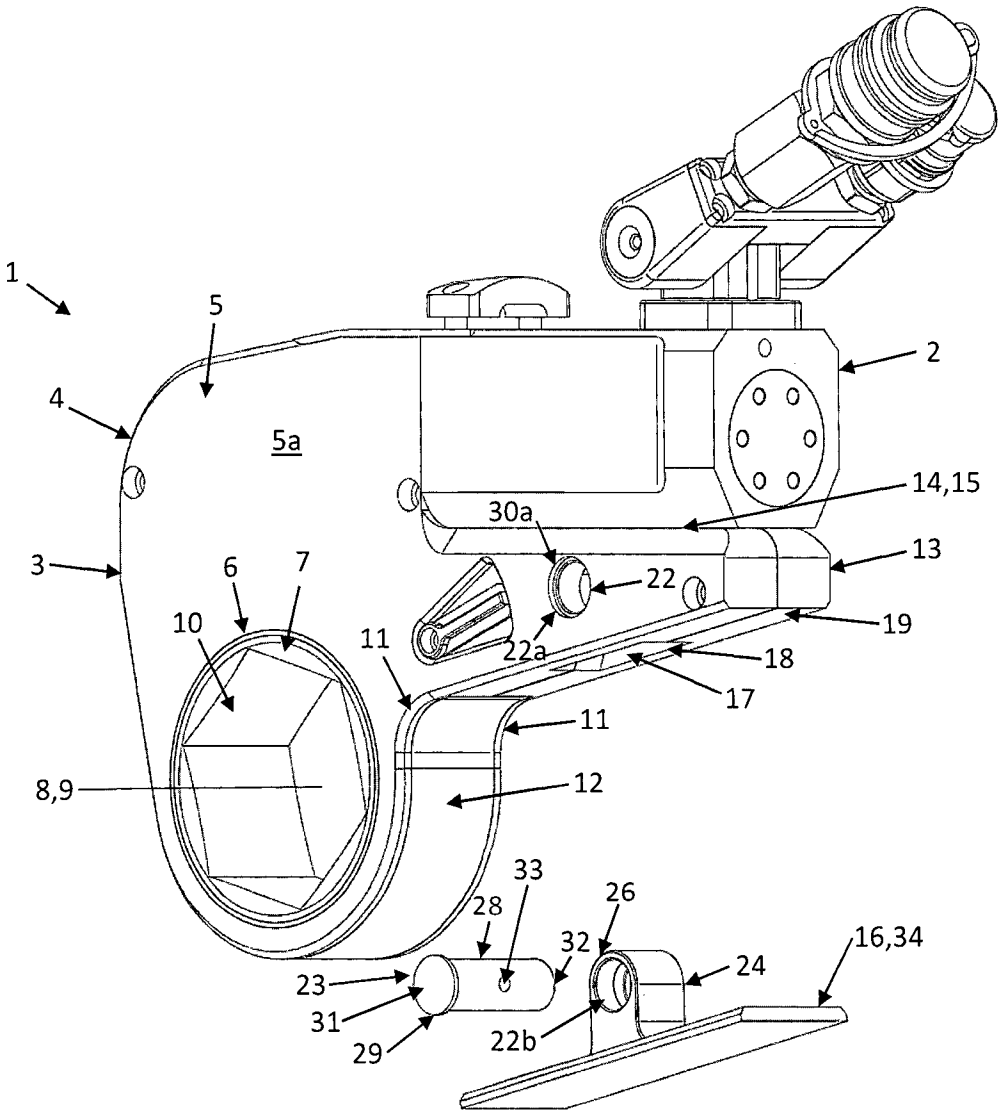
FIG. 1 shows a perspective view of an embodiment of a torque wrench according to the invention, wherein a supporting device to be fastened thereto and a bolt for fastening the same also are represented.

The exemplary embodiment of a torque wrench 1 according to the invention as shown in FIGS. 1 to 7 includes a hydraulic drive unit 2 and a ratchet unit 3, which are releasably assembled to a screwdriver unit and in the assembled condition releasably are rigidly connected with each other.

Alternatively, the torque wrench 1 also can be made in one part, i.e. the ratchet 3 and the drive 2 for the ratchet 3 can non-releasably be connected with each other.

The ratchet includes a ratchet housing 4 with two opposed side walls 5 which extend parallel to each other at a specified distance and are connected with each other. Transversely through the two side walls 5 *a* through opening 6 extends, in which a ratchet rotary body 7 is accommodated, whose axis of rotation 8 extends parallel to the axis 9 of the through opening 6. In the illustrated exemplary embodiment, the ratchet rotary body 7 in turn has a hexagonal through opening 10 for accommodating for example a hexagonal nut.

The outer circumferential edges 11 of the side wall 5 are connected with each other by means of a rim wall 12.

The ratchet housing 4 includes a cantilever arm 13 which extends away from the ratchet rotary body 7 and on its one side 14 forms a seat 15 for the hydraulic drive unit 2.

For fastening a supporting device 16 to the torque wrench 1 the ratchet housing 4 includes a free space 17 in the cantilever arm 13 between the side walls 5, which free space is accessible from outside the torque wrench 1 through an access opening 18 arranged in the rim wall 12 on the side 19 of the cantilever arm 13 facing away from the seat 15 for the hydraulic drive unit 2.

Figure 5:
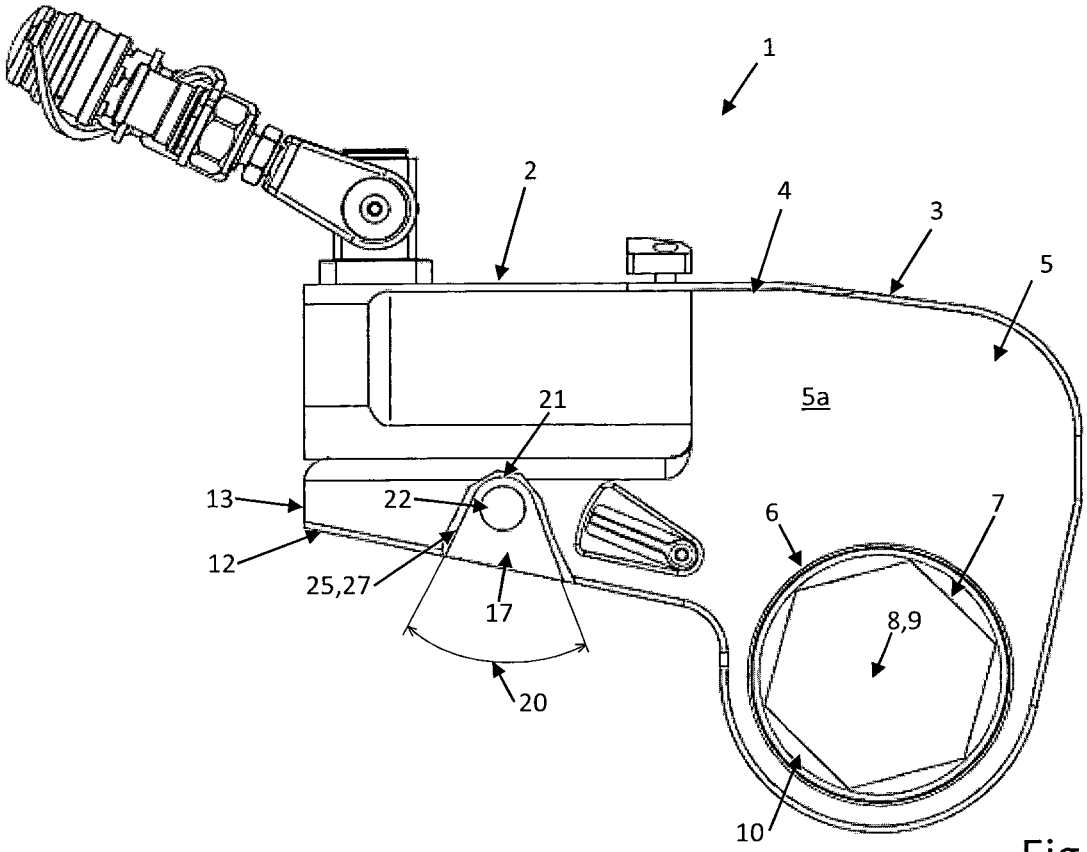
FIG. 5 shows a side view of the embodiment of FIG. 1, with a partial section in the region of the fastening means for a supporting device.

As Is shown in FIG. 5, the free space 17 in a cross-section parallel to the side walls 5—i.e. In a plane perpendicular to the axis 8, 9 of the through opening 6 or the ratchet rotary body 7—in this exemplary embodiment has the shape of a triangle which tapers into the ratchet housing 4. The size of the angle 20 of the triangle of the free space 17, which angle opens towards the access opening 18, is adapted to the requirements of the respective application.

The tip 21 of the angle 20 of the triangle opening towards the access opening 18 is rounded. In the region of this rounded tip 21 of the triangle a through-bore 22 extends, which passes through the two side walls 5 of the ratchet housing 4 and the free space 17 and is designed to accommodate a bolt 23 for fastening a fastening portion 24 of the supporting device 16. Due to the triangular shape of the free space 17, the fastening portion 24 of the supporting device 16 can easily be introduced into the free space 17.

The position of the bores 22*a* In the side wags 5 of the ratchet housing 4, i.e. the edge distances of these bores 22*a* to the edge 25 of the free space 17, and the position of the bore 22*b* In the fastening portion 24 of the supporting device 16, i.e. the edge distances of this bore 22*b* to the edge 26 of the fastening portion 24, are adjusted to each other such that the bore 22*b* In the fastening portion 24 is in alignment with the bores 22*a* in the side walls 5 of the ratchet housing 4, when the fastening portion 24 is introduced into the free space 17 as far as possible, i.e. either the fastening portion 24 in the free space 17 rests against its walls 27 or the supporting device 16 rests against the rim wall 12 of the ratchet housing 4.

For fastening a supporting device 16 the bolt 23 then is first passed through the bore 22*a* in a side wall 5, then through the bore 22*b* In the fastening portion 24—and hence through the free space 17—and finally through the bore 22*a* in the second side wall 5 of the ratchet housing 4.

FIG. 1 shows that the bolt 23 has a bolt shank 28 and a bolt head 29 whose diameter is slightly larger than that of the bolt shank 28. At least the bore 22*a* in one of the side walls 5 has a step 30 at which the bolt head 29 abuts in the inserted condition. In the inserted condition of the bolt 23 its end faces 31, 32 at the bolt head 29 and at the bolt end are flush with the outer walls 5*a* of the side walls 5 of the ratchet housing 4.

Securing the position of the bolt 23 is effected by a spring-biased ball 33 (FIG. 1), which in the inserted condition of the bot 23 is pressed into a (non-illustrated) depression in the bore wall of the fastening portion 24 of the supporting device 16.

As supporting device 16 to be fastened, FIG. 1 shows a wear plate 34 with a fastening portion 24 which extends transversely to the plane of the plate.

Figure 4:
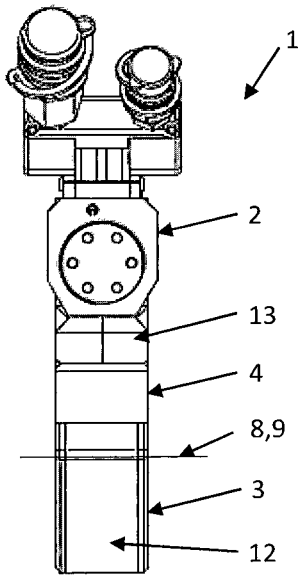
FIG. 4 shows a rear view of the embodiment of FIG. 2.
Figure 3:
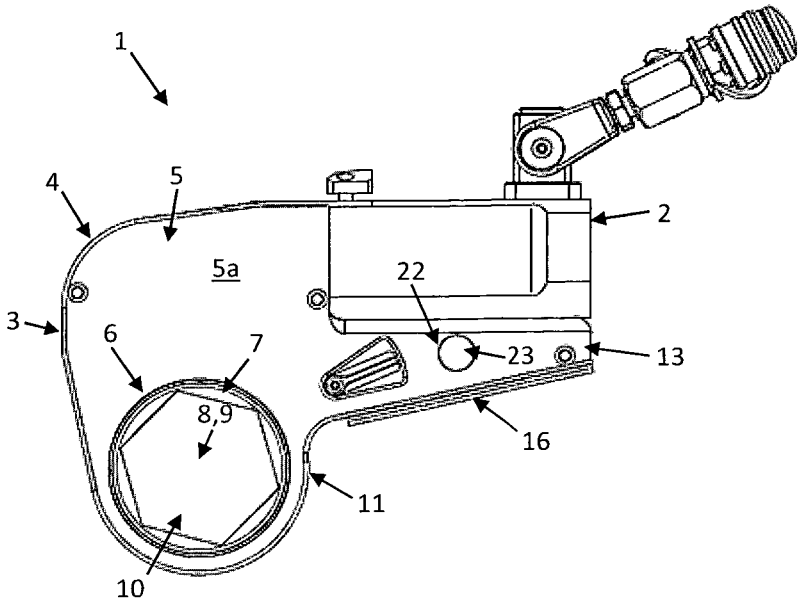
FIG. 3 shows a side view of the embodiment of FIG. 2.
Figure 2:
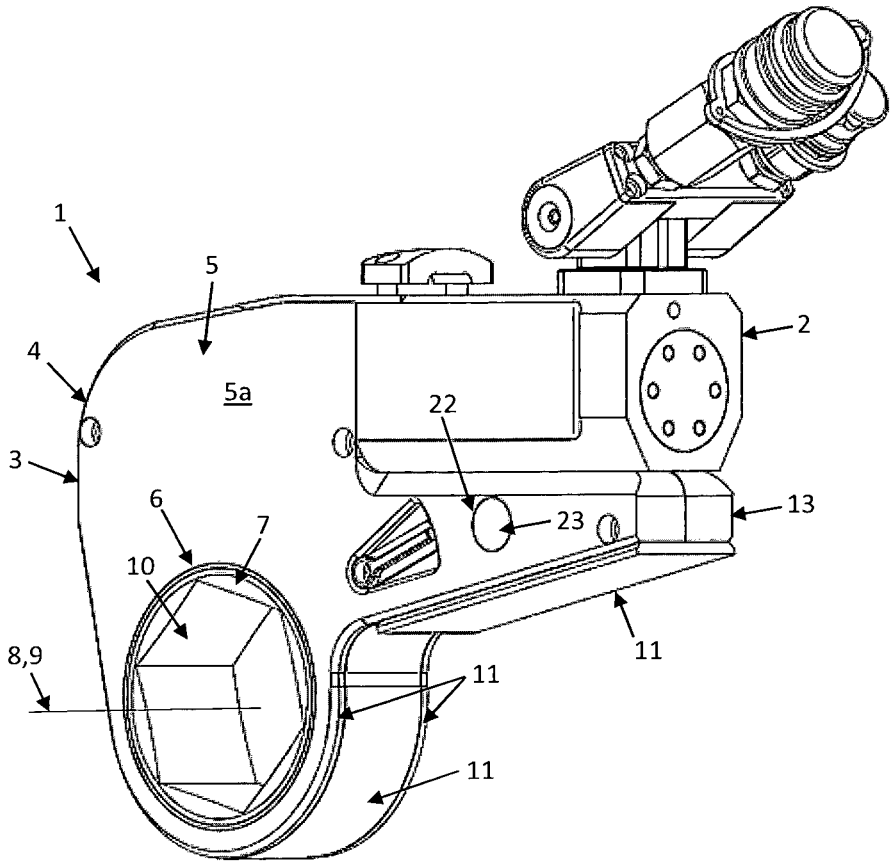
FIG. 2 shows a perspective view of the embodiment of FIG. 1, wherein the supporting device is fastened to the torque wrench by means of the bolt.
Figure 6:
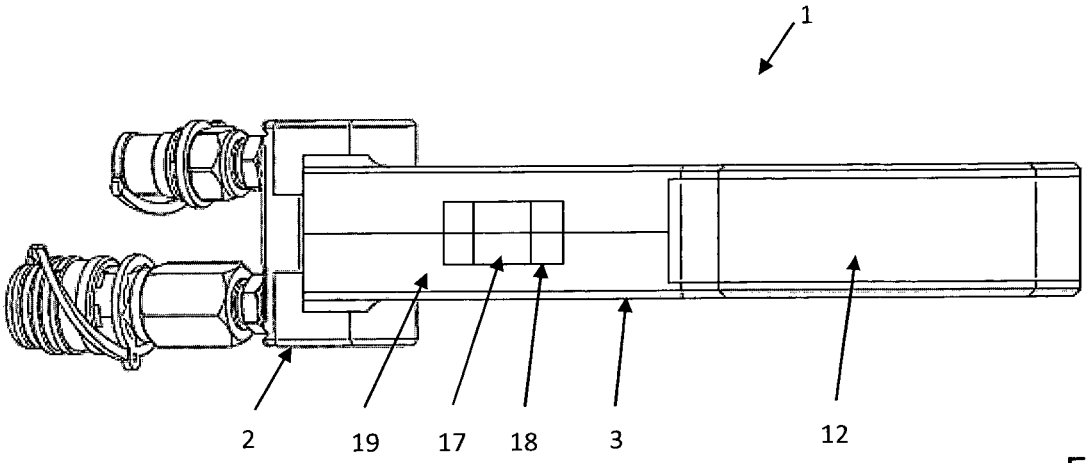
FIG. 6 shows a bottom view of the embodiment of FIG. 1.

FIGS. 2 to 4 show the torque wrench 1 of FIG. 1 with the wear plate 34 now fastened. In the fastened condition of the wear plate 34 its fastening portion 24 extends through the access opening 18 in the rim wall 12 of the torque wrench 1 (FIGS. 1 and 6) into the free space 17. As described above, the bolt 23 then extends through the bores 22*a* In the side walls 5 of the torque wrench 1 and through the bore 22*b* in the fastening portion 24 of the wear plate 34, wherein the spring-biased ball 33 for securing the position is locked in place in the depression in the bore 22*b* of the fastening portion 24.

In its condition fastened to the torque wrench 1 the wear plate 34 rests against the side 19 or rim wall 12 of the cantilever arm 13 facing away from the drive unit 2.

Figure 7:
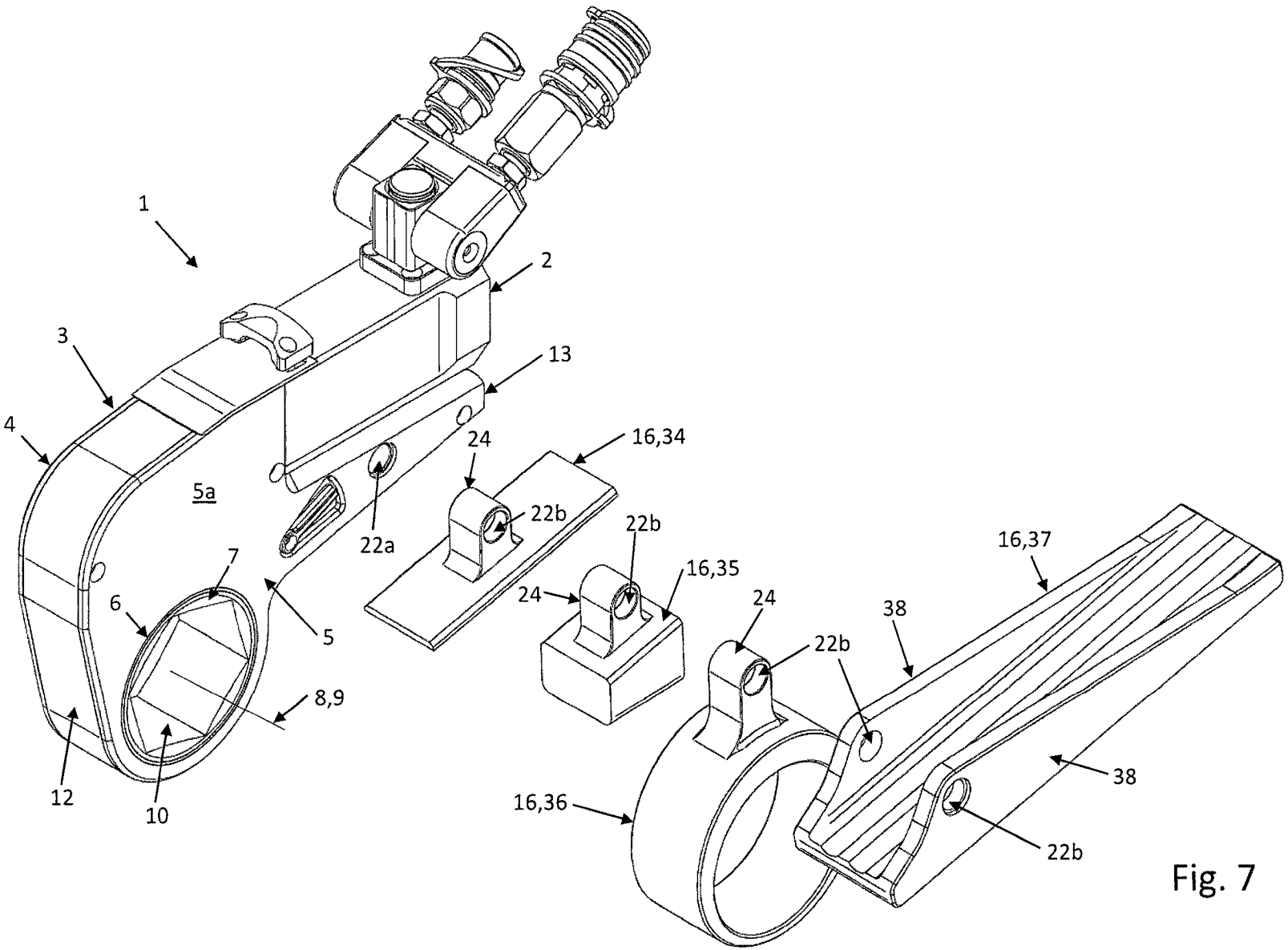
FIG. 7 shows a perspective view of the embodiment of FIG. 1, with several embodiments of a supporting device.

FIG. 7 shows some more examples for possible supporting devices 16, such as a supporting device 35 with extension for passing on the pressure or a ring supporting device 36 or a supporting device 37 with extension arm.

The supporting device 37 with extension arm has no fastening portion which is introduced into the free space 17 of the torque wrench 1, but two opposed fastening portions 38 lying on the outside, which are applied to the outside of the side was 5 of the torque wrench 1. The bolt 23 then is first passed through the bore 22*b* in the one fastening portion 38, subsequently through the bore 22*a* in the adjacent side wall 5, then through the free space 17 and finally through the bore 22*a* in the other side wall 5 and through the bore 22*b* In the other fastening portion 38.

In all cases the bores 22*a* passing through the two side walls 5 of the ratchet housing 4 and of the torque wrench 1 exclusively are loaded by the bolt 23 for fastening the supporting device 16, and therefore the bores 22*a* and the bolt 23 can optimally be arranged and dimensioned.

The invention claimed is:

1. A torque wrench comprising a ratchet and a drive for the ratchet, wherein the ratchet includes a ratchet housing comprising two opposed side walls which have a specified distance to each other and are connected with each other, a through opening extending transversely through the two side walls and being designed to accommodate a ratchet rotary body, wherein the axis of rotation of the ratchet rotary body extends parallel to the axis of the through opening, and comprising fastening means for fastening a supporting device to the torque wrench, by means of which the torque wrench can be supported perpendicularly to the axis of rotation of the ratchet rotary body, wherein the fastening means include a triangular free space between the side walls, which is exclusively arranged inside the ratchet housing and reserved and designed to accommodate a matching fastening portion of the supporting device, the matching fastening portion adapted to be introduced into and removably fixed in the triangular free space between the side walls, and wherein the fastening means include devices for fastening the fastening portion in the free space, wherein when the side walls are connected with each other by its outer circumferential edges being connected with each other by means of a rim wall, the free space inside the ratchet housing is accessible from outside the torque wrench by an access opening, wherein the access opening to the free space is arranged in this rim wall and is designed for the fastening portion of the supporting device to be guided through the same and into the free space inside the ratchet housing, and the fastening means include devices for releasably fastening the fastening portion in the free space.

2. The torque wrench according to claim 1, wherein in a plane perpendicular to the axis of the through opening the free space has a triangular cross-section which tapers into the ratchet housing.

3. The torque wrench according to claim 1, further comprising a bore extending transversely through the two side walls and the free space, which bore is designed to accommodate a bolt for fastening the fastening portion of the supporting device.

4. The torque wrench according to claim 3, wherein the fastening portion of the supporting device includes a bore which likewise is designed to accommodate the bolt and which is in alignment with the bores in the side walls of the ratchet housing, when either the fastening portion in the free space rests against its walls or the supporting device rests against the rim wall of the ratchet housing.

5. The torque wrench according to claim 1, further comprising a ratchet unit which includes the ratchet with ratchet housing, and a drive unit which includes the drive for the ratchet, wherein the ratchet unit and the drive unit can releasably be assembled to each other.

* * * * *